United States Patent [19]

Streubel et al.

[11] 4,058,154

[45] Nov. 15, 1977

[54] GUIDING AND SUPPORTING MEANS FOR CONTINUOUSLY CAST METAL STRAND

[75] Inventors: Hans Streubel, Dusseldorf, Germany; Karl Backhaus, West New York, N.J.; Wolfgang John, New York, N.Y.

[73] Assignee: Concast Incorporated New York, Montvale, N.J.

[21] Appl. No.: 725,738

[22] Filed: Sept. 23, 1976

[51] Int. Cl.[2] ..... B22D 11/12

[52] U.S. Cl. ..... 164/82; 164/448; 226/187; 226/190

[58] Field of Search ..... 226/176, 177, 181, 186, 226/187, 189, 190; 193/35 R, 35 B; 198/624; 164/282, 82; 72/246

[56] References Cited

U.S. PATENT DOCUMENTS

| | | | |
|---|---|---|---|
| 3,207,401 | 9/1965 | Everett | 226/177 |
| 3,263,284 | 8/1966 | Orr et al. | 226/176 X |
| 3,550,675 | 12/1970 | Hess et al. | 164/282 |
| 3,757,848 | 9/1973 | Scholz et al. | 164/282 |

FOREIGN PATENT DOCUMENTS

| | | | |
|---|---|---|---|
| 31,667 | 9/1971 | Japan | 164/282 |

*Primary Examiner*—Robert W. Saifer
*Attorney, Agent, or Firm*—Werner W. Kleeman

[57] ABSTRACT

A roll segment for supporting and guiding continuously cast metal strands fed therethrough, said segment comprising opposing rolls for contacting the opposite sides of a continuously cast metal strand cast through a mold and passed from said mold between said rolls. First support means for supporting the roll in contact with one of said opposite sides of said strand, second support means for supporting the roll in contact with the other of said opposite sides of said strand. Linkage means at the opposite ends of said rolls interconnect said first and second support means and maintain said rolls in substantially parallel alignment at the opposite sides of said strand. The linkage means each include a first linkage member pivotally connected at one of its ends to one of said support means, a second linkage member pivotally connected at one of its ends to the other of said support means and pivotally connected at its opposite end to said first linkage member and means interconnecting the linkage means at one end of said rolls with the linkage means at the other end of said rolls for applying a restraining force to said linkage means, said support means and said rolls for permitting restricted, limited movement of said rolls away from each other when force in excess of said restraining force is applied to said rolls by a continuously cast strand passing therebetween.

21 Claims, 10 Drawing Figures

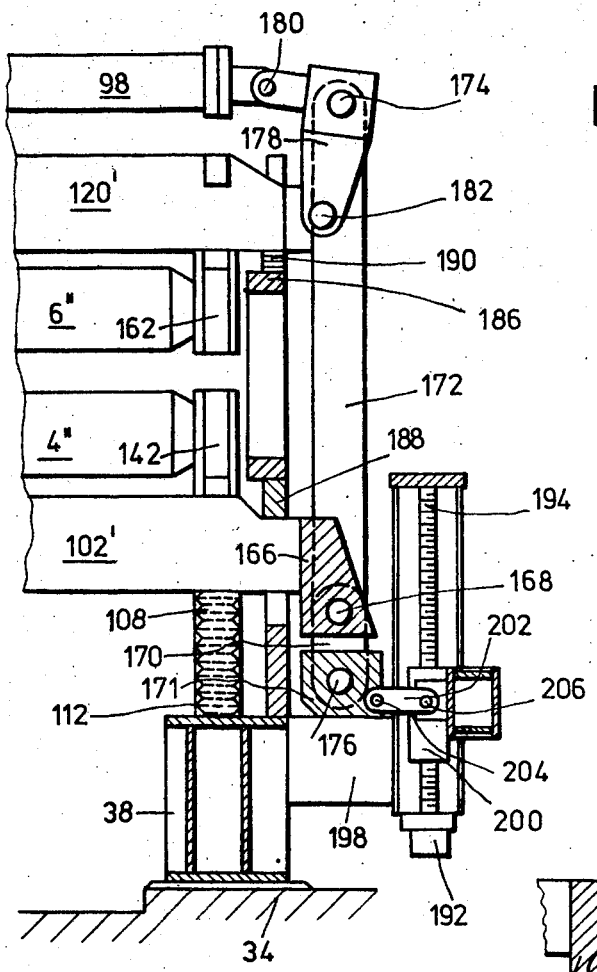
Fig. 6
Fig. 7
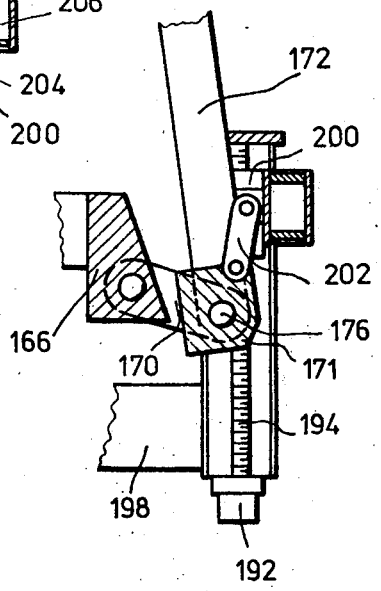

GUIDING AND SUPPORTING MEANS FOR CONTINUOUSLY CAST METAL STRAND

BACKGROUND OF THE INVENTION

This invention relates to continuous casting and, more particularly, to continuous casting of ferrous metals wherein the ferrous metal is continuously cast through a casting mold and withdrawn from such mold downwardly along an at least partly arcuate path and into a horizontal path.

Ferrous metals are continuously cast into strands by pouring hot, molten metal into the upper end of a mold and continuously withdrawing a metal strand from the bottom of such mold. As the molten metal passes through the mold, the surfaces of the metal contiguous to the mold walls are cooled, solidified and hardened to form a casing or shell of solidified metal around the molten metal in the strand. After leaving the bottom of the mold, the metal continues to cool and the casing or shell of solidified metal around the molten core thickens until the whole strand section is solidified.

The shell of solidified metal around the molten core, as the continuous cast strand leaves the mold, is relatively thin, fragile and requires support. Such support, in continuous casting of ferrous metals, is customarily provided by rolls which engage and support the opposite sides of the continuously cast strand. The supporting rolls immediately below the mold, where the shell of solidified metal round the strand core is thin, are usually of relatively small diameter and are longitudinally spaced closely together. To assist cooling of the slab and the thickening of the shell of solidified metal, such supporting rolls immediately below the casting mold may be liquid cooled. Further away from the mold bottom, where the metal has cooled and the shell of solid metal has thickened, rolls of larger diameter, spaced at greater longitudinal distance, are usually employed. To control the casting speed, certain of the supporting and guiding rolls may be driven.

In conventional continuous casting it is known to press guiding and supporting rolls with spring-load against stop means or directly against the strand surface. The disadvantage of such a solution is the increase in said spring-load because of perpendicular movement of said rolls by said strand. The differing restraining force prevails according to the characteristic line of the spring (spring constant) and usually is approximately proportional to the length of compression. Such an increase of the restraining force applied to the rolls is undesirable because the rolls are not protected against overload and roll damage will occur. Another disadvantage is the high cost of spring means directly acting at the support rolls of large slab casting machines, because the directly acting spring-load applied at the supporting rolls for the purpose of counteracting a ferrostatic pressure of about 10 meters height or more is very high.

Conventionally, in continuous casting, the opposing supporting and guiding rolls are divided into segments. The rolls are mounted on supporting elements. The supporting element carrying the rolls at one side of the strand is mounted in the segment for movement relative to the supporting element carrying the rolls at the opposite side of the strand in a direction normal to the strand casting axis. The distance between the supporting elements and opposing supporting rolls is usually adjusted by stops selectively inserted between the elements and by urging such elements into engagement with such stops. By changing the thickness of such stops, the cross section or thickness of the cast strand may be changed.

During normal casting operation, the elements are held in engagement with the stops so that the distance between the opposing supporting and guide rolls is maintained constant. This is accomplished by applying a restraining force of sufficient magnitude to the elements to maintain the supporting rolls in contact with the strand being continously cast. The magnitude of the restraining force applied to the elements should be so great that, on the one hand, the ferrostatic pressure is kept under control and, on the other hand, damage to the rolls, roll supports and segments will not result should abnormal casting conditions occur. For example, if the casting machine should be slowed down or stop, a breakout of the casting metal should start and heal over or, if for some other reason, there should occur a bulge or irregularity in the strand being cast, movement of the supporting elements and rolls to allow passage of the bulge or irregularity is desirable. Otherwise, there would be damage to the continuous casting apparatus. By permitting the supporting elements and rolls to open up while, at the same time, maintaining the rolls in supporting contact with the strand, integrity of the strand, particularly at the upper part of the path where the core is molten, can be maintained. The restraining force applied to the supporting elements and rolls which maintains the rolls in supporting contact with the strand being cast and which, at the same time, permits movement of opposing rolls away from each other, normal to the casting axis, should remain constant during such movement. Otherwise, unequal supporting forces will be applied to the strand and casting equilibrium would be disrupted. One means heretofore employed for applying such restraining force to the supporting elements and opposing rolls has been by hydraulic units mounted at the sides of the segments and interconnecting the elements.

One of the difficulties in using hydraulic units for applying restraining forces has been the failure of such units when a pressure failure occurs. Such pressure failure not only effects the elements at the unit causing such failure but also results in failure in all units connected thereto. Furthermore the hydraulic fluid required by such units is subject to combustion when leakage occurs and the resulting fire can cause extensive damage to the casting equipment. Hydraulic fluid leakage also results in contamination of the cooling medium used to cool the cast strand. Such contamination not only adversely effects the cooling but also cause damage to the cast strand.

SUMMARY OF THE INVENTION

It is an object of this invention to provide an improved apparatus for and method of guiding and supporting a strand in the cooling zone as well as in the withdrawal and straightening machine by largely replacing the hydraulic system by mechanical means.

Another object of the invention is the application of a mechanical force to the guiding and supporting rolls which is maintained substantially constant during movement of such rolls and a reduction of cost of such a mechanical guiding and supporting apparatus.

The present invention eliminates the drawbacks of hydraulic systems and the hazards thereof. This is accomplished in the instant invention by mechanical arrangements of levers and springs, whereby the mechanical spring preload combined with the behaviour of the linkage system, one compensating the other in a novel manner, provide substantially constant and uniform supporting and guiding forces to the strand being continuously cast irrespective of movement which might occur between opposing rolls.

Another advantage of the invention is freedom of the system from hoses, high pressure and high maintenance hydraulics. The use of mechanical parts reduces the requirements for heat protection as compared with equivalent hydraulic systems and the use of possibly flammable fluids.

A further advantage of the system is its compact size and minimum width which is positioned directly above the roll group allowing closer roller spacing. The arrangement of a single common mechanical spring pack reduces considerably the machine cost and improves the accessibility to the machine.

The levers and springs in the various segments in the apparatus of the present invention are arranged so as to provide the required support and guide to the continuously cast strand as it passes through such segments. Thus, in certain of the segments one of the support elements and opposing rolls is fixed, while the other is movable, in other segments both support elements and rolls are movable and, in still other segments, both support elements and rolls can be lifted so as to accommodate a strand which has become warped or arched.

BRIEF DESCRIPTION OF THE DRAWINGS

The invention of the present application will be more fully understood from the following description and appended drawings of a preferred embodiment of the invention in which:

FIG. 6 is a front view, partly in section, taken at VI—VI, FIG. 1;

FIG. 7 is a view of a portion of the apparatus of FIG. 6 but showing the actuator in its extended position;

DETAILED DESCRIPTION OF THE PREFERRED EMBODIMENTS

Figure 1:
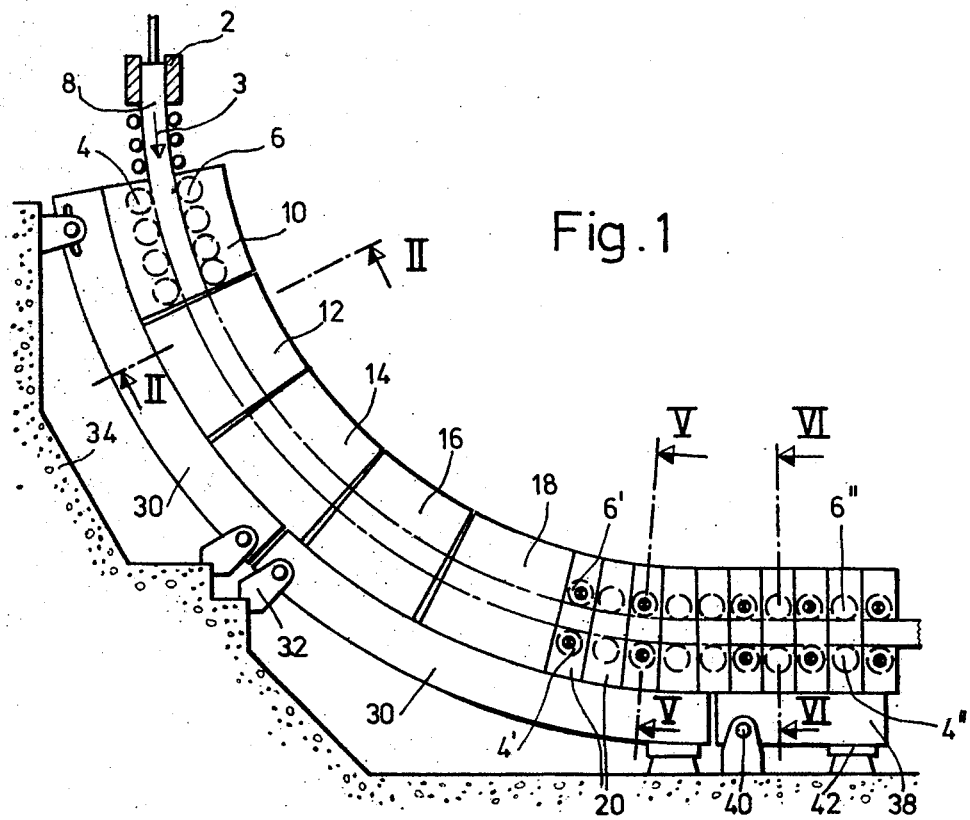
FIG. 1 is a diagrammatic view from the side showing the arcuate and horizontal support and guide paths of the roll arrangement of the invention.

Referring to FIG. 1 of the drawings, a continuous casting apparatus includes casting mold 2 and opposing rolls 4, 6, 4', 6',4'', 6'' arranged to engage the opposite sides of continuously cast strand 8, discharged from the bottom of mold 2, in the direction of arrow 3, and to support and guide strand 8, first through an arcuate path and into and through a horizontal path. For purposes more apparent hereinafter, the rolls 4, 6, at the upper end of the arcuate path, adjacent the mold 2, are grouped into segments, generally designated 10, 12, 14 16, 18. The segments 10–18 contains four sets of opposing rolls 4, 6. For reasons more apparent hereinafter, segments 20 in the lower portion of the arcuate path and in the horizontal path, contain only one pair or one set of opposing rolls 4', 6', 4'', 6''. The segments 10–18 are mounted on base 30, fixed at 32 to foundation 34. Base 38 is fixed, at 40, 42 to foundation 34. Except for the number of pairs of opposing rolls 4, 6 contained therein, the apparatus configuration of segments 10–18 are the same.

Figure 2:
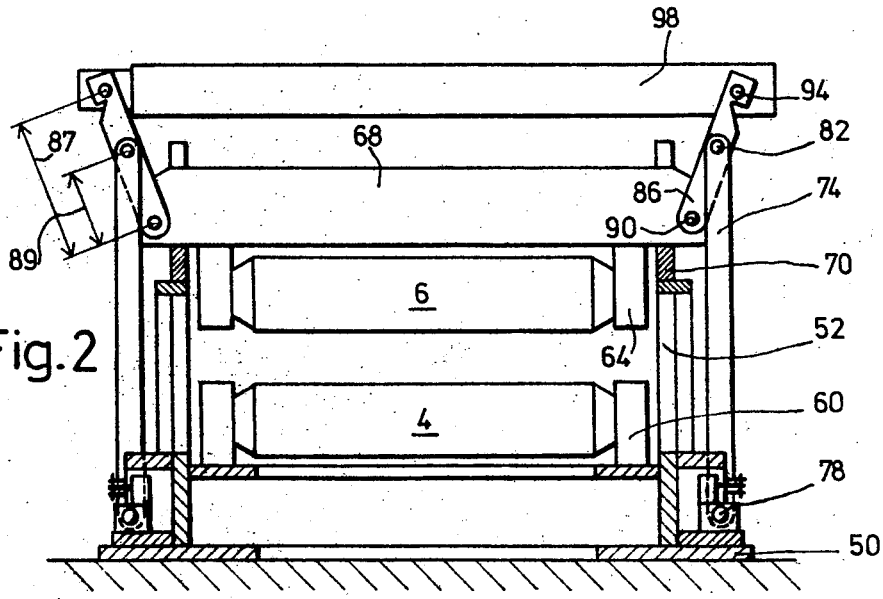
FIG. 2 is a front view, partly in section, taken at II—II, FIG. 1 and showing one of the roll segment embodiments of the invention.
Figure 3:
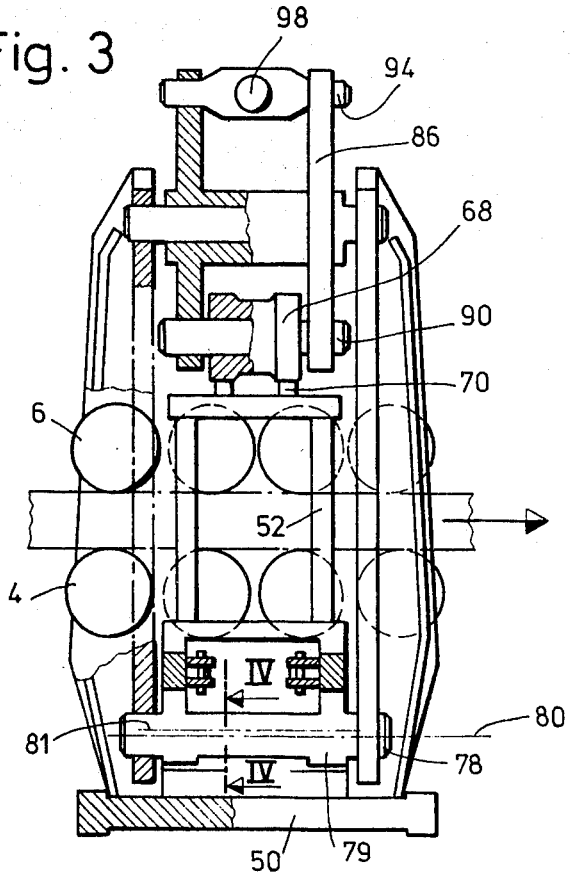
FIG. 3 is an end view, partly in section, of the apparatus of FIG. 2.
Figure 4:
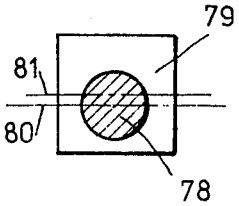
FIG. 4 is a view taken at IV—IV, FIG. 3.

Referring to FIGS. 2, 3 and 4, the segments in the secondary cooling zone each include a fixed support 50, having column 52, extending upwardly therefrom. Rolls 4 are mounted on the fixed support 50 by bearing block 60. Rolls 6 are mounted on movable support 68 by bearing block 64. Stop 70 on the column 52 limits the movement of the movable support 68 and the rolls 6 toward the fixed support 50 and the rolls 4, as will be more fully described later herein.

Link 74 at the ends of the rolls 4, 6 is pivoted at one of its ends by pivot 78, to the fixed support 50 and is pivoted at its opposite end, by pivot 82, to link 86 which, in turn, is pivoted at one end, by pivot 90 to the movable support 68, and at the opposite end, by pivot 94, to one end of compression spring unit 98. As is obvious from the drawings, especially FIG. 2, the opposite end of the spring unit 98 is pivotally connected, at the opposite ends of the rolls 4, 6, to a linkage system identical to the system just described.

The pivot 78 is connected with block 79, so that center-line 80 of the pivot 78 is off-set to center-line 81 of the block 79 (FIG. 4). The pivot 78 with the block 79 are removably mounted in the column 52 so that each block 79 might be removed, rotated 180° and re-inserted in the segment. By so removing, rotating and re-inserting the block 79 in the column 52, the spacing of the support 68 and the roll 6 relative to the support 50 and the roll 4 is increased or decreased, as the case may be.

With arrow 87 (FIG. 2) the length of a moment arm of the spring load entry side and with arrow 89 the length of the moment arm of the spring load exit side is shown. The magnitude of the resulting force of the bell-crank system given to the support roller is influenced by the proportion of these moment arms.

Figure 5:
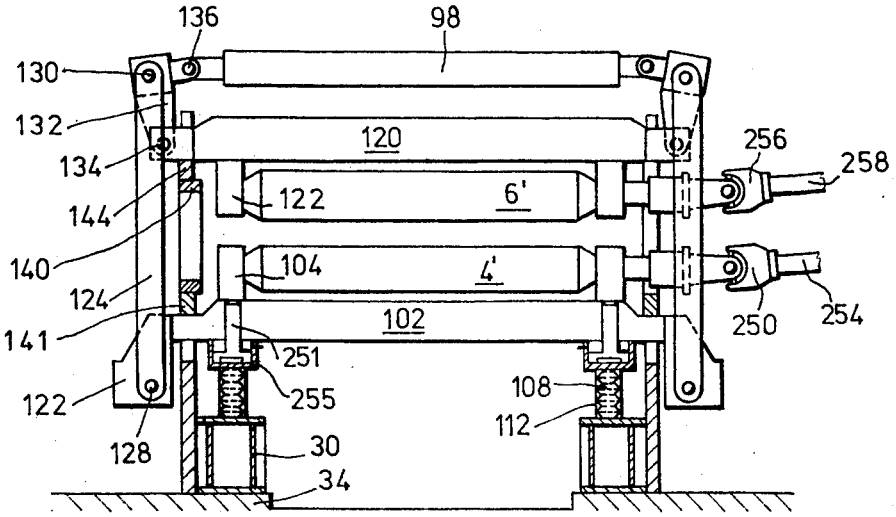
FIG. 5 is a front view, partly in section, taken at V—V, FIG. 1.

Referring now to FIG. 5, there will be seen a roll segment with a single pair of driven rolls 4' and 6' which is usually arranged below the multiroll segment 18 (FIG. 1) and at the point where such arcuate path joins the horizontal support and guide path.

The roll 4' is mounted on support 102 by bearing blocks 104. The support 102 is mounted near each end on compression spring 108, in housing 112 fixed on base 30 attached to the foundation 34. These compression springs 108 compensate the weight of the roll 4' and that of the support 102. The roll 6' is mounted on support 120 by bearing blocks 122. The linkage system, in this embodiment, interconnecting the roll supports 102 and 120 at the right and left hand ends of the supports 102, 120 are identical.

The support 102 extends at its ends downward, toward the foundation 34. At its lower ends 122 a respective link 124 is pivotally connected to each such end 122 of the support 102 by pivot 128. The upper end of each link 124 is pivotally connected by pivot 130 to link 132 which, in turn, is pivotally connected at one of its ends, by pivot 134 to the support 120 and at its opposite end, by pivot 136, to one end of the spring unit 98. Spacer 140 has, at its lower end spacer block 141 and, at its upper end stop 144. The supports 102, 120 are held against the spacer block 141 and the stop 144 onto the spacer 140 by the restraining force of the spring unit 98. By substituting stops 144 of different thickness, the normal distance between the support 102 and the roll 4' and the support 120 and the roll 6' may be adjusted. Such adjustment will, of course, depend upon the thickness of the strand to be continuously cast.

The roll 4' is connected through universal joint 250 and drive shaft 254 to a driving unit, such as an electric motor, not shown. The roll 6' is similarly connected through universal joint 256 and drive shaft 258 to a drive unit, not shown. Thus, through the drive units and the shafts 254, 258 the rolls 4', 6' are driven to insert the dummy bar up to the mold and to withdraw the continuously cast strand.

To accommodate the cast strand and, at the same time, provide for engagement of the driven rolls 4', 6' with a dummy bar, not shown, which is slightly thinner than the cast strand, the bearing blocks 104 carrying the roll 4' are mounted for vertical adjustment on support 102 by piston rods 251, the pistons of which are mounted in cylinders 255 connected by hydraulic lines to a pressure source, not shown, of hydraulic fluid. To contact the dummy bar, hydraulic fluid or grease under pressure is pumped into the cylinders 255, bringing the roll 4' into driving contact with the dummy bar. After the dummy bar has passed roll 4' it is desired to lower the roll 4'. The hydraulic fluid or grease under pressure is therefore released from the cylinders 255. If this type of segment is used without drive means, the vertical adjustment of the roll 4' with the piston rods 251 and the cylinders 255 are deleted.

Referring next to FIGS. 6 and 7, a roll segment in the horizontal portion of the support and guide path, is made up of a single pair of rolls, one designated 4'' and located at one side of a cast strand and the other designated 6'' and located at the other side of such strand.

The roll 4'' is mounted on support 102' by bearing blocks 142, only one of which is visible in the drawing, and since the mounting of the rolls 4'' and 6'' at opposite ends is identical it will suffice to consider one end of the arrangement. The support 102' is mounted on compression springs 108 in housings 112 fixed on base 38 attached to the foundation 34. The roll 6'' is mounted on support 120' by bearing blocks 162. The linkage system in this embodiment, interconnecting the roll supports 102' and 120' at the opposite ends of the supports are identical.

End 166 of the support 102' extends downwardly toward the foundation 34 and is pivotally connected by pivot 168 to link pivot block 170. At the lower end of the pivot block 170 link 172 is connected at pivot 176 to such pivot block 170. At its upper end the link 172 is pivotally connected by pivot 174 to link 178, in turn, pivotally connected at its opposite ends by pivot 180 to the ends of the spring unit 98 and with pivot 182 to the support 120'. Spacer 186 has at its lower end spacer block 188 and, at its upper end, a stop 190 which is mounted between the supports 102' and 120'. The supports 102', 120' are held against the spacer block 188 and the stop 190 by the restraining force of the spring unit 98. The distance between the rolls 4'', 6'' is adjusted by substituting the stops 190 with stops of different thickness. The spacer 186 is fixed on the base 38.

To lift the upper roll 6'' there are provided means for releasing the restraining force applied to the support, 120' of such upper roll which may comprise an electric motor 192 with a worm gear and a spindle 194 driven thereby mounted on bracket 198 on the base 38. Two such motor-worm gear units are provided, one at each end of the roll support segment.

Figure 9:
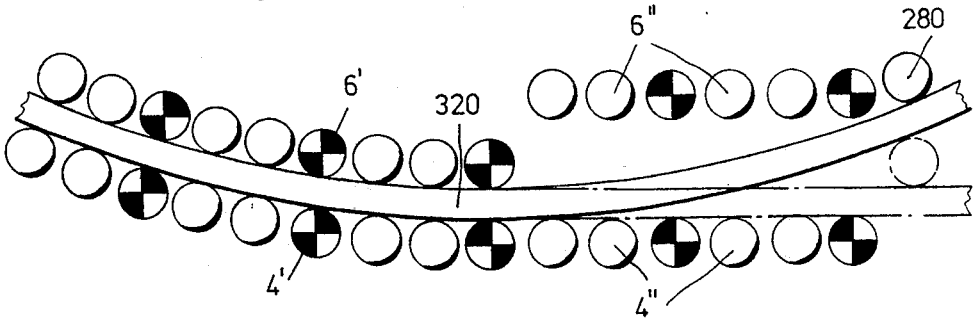
FIG. 9 is an enlarged diagrammatic view from the side of the lower end of the arcuate support and guide path and the horizontal support and guide path of the apparatus of the invention.

Worm gear follower 200, threaded on the worm spindle 194, is connected by link 202 and pivots 204, 206 to block 171. When the worm spindle 194 and the gear follower 200 are positioned by the motor 192 so that the follower 200 is in the lowered position of FIG. 6 the supports 102' and 120' as well as the rolls 6'' and 4'' are in the normal strand guiding and supporting position. When the follower 200 is in the raised position, FIG. 7, the support 120' and the roll 6'' are raised and the roll 6'' is in the raised position. The motor 192 and the worm spindle 194 may be actuated manually or by an appropriate sensor in the guide path to raise roll 6''. The segments of FIG. 6 with provisions for opening the spacing between the rolls 4'', 6'' are particularly suited for the horizontal portion of the strand guide as shown in FIG. 9.

Figure 8:
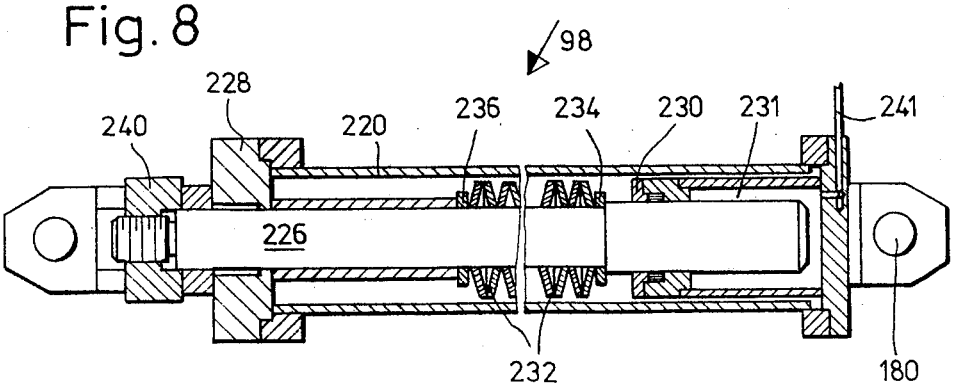
FIG. 8 is an enlarged view, in section, of the spring load unit of the apparatus of the instant invention.

With reference to FIG. 8, the spring unit 98 includes housing 220 pivotally connected with the pivot 180 to the links at one end of the support and guide segment and rod 226 mounted for sliding, telescoping travel in the housing 220 in guides 228, 230, fixed to the housing 220. Compressible spring discs 232 are mounted on the rod 226 and are compressed between shoulder 234 on the rod 226 and stop 236 on the housing 220. The compression or initial loading of the spring discs 232 in the spring unit is accomplished by adjusting nut 240 threaded on the end of the shaft 226. Thus, by adjusting the nut 240 on the shaft 226, the restraining force of the spring unit 98 applied to the lever system to hold the roll support element in engagement with the stops and the rolls 4, 4', 4'' and 6, 6', 6'' in engagement with the strand being cast is regulated. As a bulge or enlargement on the surface of such strand engages such rolls, the spring discs 232 in the spring unit are further loaded and compressed, the roll support elements are moved apart as such bulge or enlargement passes through the rolls and the cast strand is passed without damage to the rolls.

In the spring housing 220, at its right end, a fluid tight chamber 231 around the inner end of the shaft 226 is foreseen. Fluid conduit 241 is connected, at one of its ends to the fuid tight chamber 231 and, at its other end, is connected to a suitable fluid pressure source. For purposes of extending the rod 226 from the housing 220 such as, for example, to move the roll 6 away from the roll 4 or to maintain such rolls spaced once spacing has occurred because of a bulge in the cast strand, hydraulic fluid or grease may be pumped into the chamber 231 through the conduit 241. Such hydraulic fluid or pumped grease would of course, be released from the housing when it is desired to return the unit to normal spring operation.

Instead of interconnecting the linkage means placed at the opposite ends of the rolls with one common spring means as shown in FIG. 8, it is of course possible to place spring means with the same spring force and half the spring path at each side of the opposite ends of the rolls and externally of the linkage means. Such separate spring means then would be secured in any convenient manner to the foundation. The springs thus may be placed at an advantageous distance outside of the hot part of the casting machine, and thereby are protected against thermal effects.

FIG. 9 shows the horizontal strand guide in case of an abnormal casting condition, such as e.g. a breakout. A strand 320 in the arcuate roller apron is fully solidified and at a low temperature. To prevent damage to the rolls of the straightening machine, the arcuate strand will be straightened in a different manner. The rolls 6'' of the horizontal path may be lifted allowing the curved end of the strand 320 to enter the horizontal section. After a sufficient length has entered, the curved end may be bent downward with a special straightening roll 280 for such cases of abnormal casting condition or if desired the unstraightened strand may be cut with a cutting torch.

Figure 10:
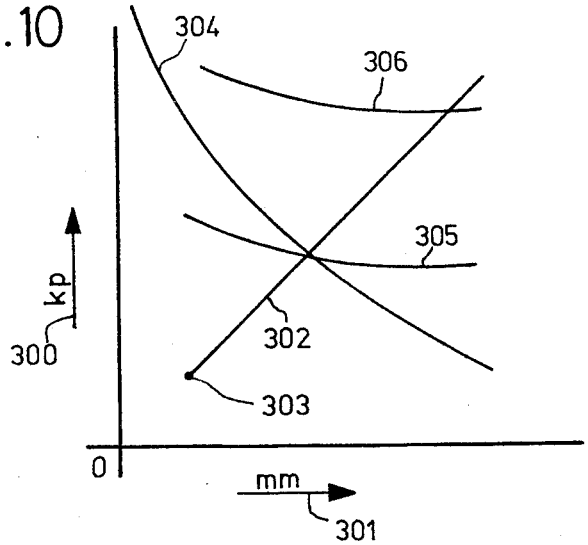
FIG. 10 shows diagrammatically the relation of the characteristic-line of a spring disc unit to the characteristic-line of a bell crank.

In the diagram in FIG. 10 an arrow 300 on the vertical axis designates forces in kp and arrow 301 on the horizontal axis designates in mm the compression of the spring and the length of roll movement respectively. Line 302 signifies the characteristic line of a preloaded disc spring with a preload according to point 303. 304 marks the theoretical closing force in kp of a bell-crank system if a constant restraining force as for instance a hydraulic force were to be applied. This line 304 is therefore called the characteristic line of a bell-crank. If a spring with a spring characteristic line 302 is combined with a bell-crank system with its characteristic line 304, a force according to line 305 is the result. This force is then applied to the rolls 4, 6. The magnitude of the resulting force of the bell-crank system is dependent on the proportions of the moment arms of the levers on the force-entry and the force exit sides respectively and may be varied by altering these as desired. Line 306 shows a higher resulting force which is produced with the same spring-force but with a different proportion of the moment arms of the bell-crank. The magnitude of this force is adapted to counteract the ferrostatic pressure, so that no bulging of the casting can occur. The length of the roll movement away from the predetermined roll position is chosen to comply with the requirements, e.g. 1 inch for the upper and lower roll respectively.

The following example may explain how this combination of a spring with a bell-crank works. If a bulge or enlargement in the cast strand passes through the supporting and guiding rolls, the load required to compress the springs increases as such springs are compressed. Such increase in loading is due to the spring characteristic line 302 of the springs and, under normal circumstances, would result in an increase of the loading applied to the cast strand by the supporting and guiding rolls. Such increase in loading on the cast strand is undesirable and is avoided, in the instant invention, by the arrangement of the spring unit with the linkage system and the pivotal interconnection of such a system. The spring unit 98 (FIGS. 2, 3, 5, 6, 8,) and the linkage system arranged and attached to the roll support elements form a self adjusting bell-crank. As the compressive force and load of the spring unit 98 increases, the effective bell-crank moment about which such force is applied to the roll supports 120, 102 and rolls 6, 4 decreases according to the bell-crank characteristic line 304. This decrease in moment arm offsets the increase in compressive force or load to the rolls. The resulting force applied to the strand being continuously cast is therefore maintained substantially constant.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A roll segment for supporting and guiding continuously cast metal strands fed therethrough, said segment comprising opposing rolls for contacting the opposite sides of a continuously cast metal strand cast through a mold and passed from said mold between said rolls, first support means for supporting the roll in contact with one of said opposite sides of said strand, second support means for supporting the roll in contact with the other of said opposite sides of said strand, linkage means at the opposite ends of said rolls for interconnecting said first and second support means and for maintaining said rolls in substantially parallel alignment at the opposite sides of said strand, said linkage means each including a first linkage member pivotally connected at one of its ends to one of said support means, a second linkage member pivotally connected at one of its ends to the other of said support means and pivotally connected at its opposite end to said first linkage member, and means for applying a restraining force to said linkage means, said support means and said rolls for permitting restricted, limited movement of said rolls away from each other when force in excess of said restraining force is applied to said rolls by a continuously cast strand passing therethrough, said restraining force means and said linkage means applying a restraining force to said support means and said rolls when the cast strand is guided between said rolls as well as when said rolls are moved away from each other.

2. A roll segment for supporting and guiding continuously cast metal strands fed therethrough, said segment comprising opposing rolls for contacting the opposite sides of a continuously cast metal strand cast through a mold and passed from said mold between said rolls, first support means for supporting the roll in contact with one of said opposite sides of said strand, second support means for supporting the roll in contact with the other of said opposite sides of said strand, linkage means at the opposite ends of said rolls for interconnecting said first and second support means and for maintaining said rolls in substantially parallel alignment at the opposite sides of said strand, said linkage means each including a first linkage member pivotally connected at one of its ends to one of said support means, a second linkage member pivotally connected at one of its ends to the other of said support means and pivotally connected at its opposite end to said first linkage member, and means for applying a restraining force to said linkage means, said support means and said rolls for permitting restricted, limited movement of said rolls away from each other when force in excess of said restraining force is applied to said rolls by a continuously cast strand passing therethrough, said restraining force means and said linkage means applying a restraining force of substantially constant magnitude to said support means and said rolls as said rolls are moved away from each other.

3. A roll segment for supporting and guiding continuously cast metal strands fed therethrough, said segment comprising opposing rolls for contacting the opposite sides of a continuously cast metal strand cast through a mold and passed from said mold between said rolls, first support means for supporting the roll in contact with one of said opposite sides of said strand, second support means for supporting the roll in contact with the other of said opposite sides of said strand, linkage means at the opposite ends of said rolls for interconnecting said first and second support means and for maintaining said rolls in substantially parallel alignment at the opposite sides of said strand, said linkage means each including a first linkage member pivotally connected at one of its ends to one of said support means, a second linkage member pivotally connected at one of its ends to the other of said support means and pivotally connected at its opposite end to said first linkage member, and means interconnecting the linkage means at one end of said rolls with the linkage means at the other end of said rolls for applying a restraining force to said linkage means, said support means and said rolls for permitting restricted, limited movement of said rolls away from each other when force in excess of said restraining force is applied to said rolls by a continuously cast strand passing therebetween.

4. A roll segment, as recited in claim 3, in which said interconnecting means for applying a restraining force includes spring means.

5. A roll segment, as recited in claim 4, in which said spring means includes a first member connected to said linkage means at one end of said rolls, a second member connected to said linkage means at the other end of said rolls and a compressively loaded spring intermediate said first and second spring means member.

6. A roll segment, as recited in claim 5, in which said spring means includes means for adjusting said first spring means member relative to said second spring means member for regulating the compressive loading of said spring.

7. A roll segment, as recited in claim 3, in which said segment includes a plurality of opposing rolls for contacting the opposite sides of a continuously cast metal slab.

8. A roll segment, as recited in claim 7, in which the plurality of opposing rolls in contact with one of said opposite sides of said slab are supported by said first support means and the plurality of opposing rolls in contact with the other of said opposite sides of said slab are supported by said second support means.

9. A roll segment, as recited in claim 3, in which said linkage means includes means for releasing said restraining force applied to said support means and said rolls when the movement of said rolls away from each other exceeds a predetermined distance.

10. A roll segment, as recited in claim 3, in which said pivotal connection of said second linkage member to said other of said support means includes means for adjusting the distance between said first and second support means and between said rolls.

11. A roll segment, as recited in claim 10, in which said adjusting means includes a block and said second linkage member is pivotally connected to said block by a bearing mounted eccentric to the center line of said block.

12. A roll segment, as recited in claim 11, in which the adjustment of the distance between said first and second support means and between said rolls is effected by reversing said block to thereby position the eccentric mounting of said bearing at the opposite side of the center line of said block.

13. A roll segment, as recited in claim 3, in which said means interconnecting and applying a restraining force to said linkage means is connected at its opposite ends to said first linkage members.

14. A roll segment, as recited in claim 13, in which said means interconnecting and applying a restraining force to said linkage means is connected at its opposite ends to said first linkage members and said second linkage members are connected to said first linkage members intermediate the opposite ends of said first linkage members.

15. A roll segment, as recited in claim 13, in which said means interconnecting and applying a restraining force to said linkage means is connected at its opposite ends to one of the ends of said first and said second linkage members.

16. A roll segment, as recited in claim 10, in which said means for adjusting the distance between said first and second support means and between said rolls includes a block and means for locking said block in a first position in which said rolls are in contact with the opposite sides of said strand and for swinging said block from said first lock position to a second position where at least one of said rolls is out of contact with said strand.

17. A roll segment, as recited in claim 16, in which said means for locking and for swinging said block includes a screw jack and screw jack drive.

18. A roll segment, as recited in claim 17, in which said screw jack is connected to said block by a link which, when said block is in said first lock position, is substantially at 90° to the force applied to said block by said second linkage member.

19. A method for supporting and guiding a continuously cast metal strand between a plurality of rolls acting at opposite sides of the strand surface, comprising the steps of:

urging under spring-load having a spring-load characteristic line at least one of the rolls towards the strand surface;

applying said spring-load to said one roll by means of a bell crank having a bell-crank characteristic line; and compensating the spring-load characteristic line by means of the bell-crank characteristic line in a manner to thereby produce a substantially constant load along the length of roll movement.

20. A method for supporting and guiding a continuously cast metal strand with rolls urged essentially perpendicularly towards a guided and supported strand surface and supported by roll support means, comprising the steps of:

interconnecting said roll support means with a bell crank system having a bell-crank characteristic line;

applying to said bell crank system a spring-load characterized by a spring-load characteristic line to urge said roll support means and thus said rolls into supporting and guiding engagement with said strand;

utilizing the bell-crank characteristic line to at least partially compensate the spring-load characteristic line such that as said rolls and said roll support means are moved away from each other by said strand the characteristic line of said spring-load tends to increase the supporting and guiding engagement force applied to said strand and the characteristic line of said bell-crank tends to at least partially compensate for said increased supporting and guiding engagement force.

21. A method for supporting and guiding a continuously cast metal strand, as recited in claim 20, including the steps of:

structuring the bell crank system and spring-load such that the magnitude of the resulting force of the bell crank system is obtained by adapting a desired proportion of the moment arm of the spring-load applied to the roll support means and the moment arm of the force applied by said bell crank system to said roll support means.

* * * * *